US008186092B2

(12) United States Patent
Williams

(10) Patent No.: US 8,186,092 B2
(45) Date of Patent: May 29, 2012

(54) INTEGRATED DUAL TECHNOLOGY BRUSH

(75) Inventor: Lawrence Williams, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 289 days.

(21) Appl. No.: 12/551,763

(22) Filed: Sep. 1, 2009

(65) Prior Publication Data

US 2011/0047853 A1 Mar. 3, 2011

(51) Int. Cl.
*F41A 29/02* (2006.01)

(52) U.S. Cl. ..... 42/95; 15/104.2; 15/114

(58) Field of Classification Search ... 42/95; 15/104.16, 15/104.2, 114
See application file for complete search history.

(56) References Cited

U.S. PATENT DOCUMENTS

| | | | | |
|---|---|---|---|---|
| 358,304 | A * | 2/1887 | Simpson | 15/104.18 |
| 4,144,609 | A | 3/1979 | Dubs | |
| 4,547,924 | A | 10/1985 | Brygider | |
| 4,716,673 | A | 1/1988 | Williams et al. | |
| 4,901,465 | A | 2/1990 | Hsu | |
| 4,962,607 | A | 10/1990 | Baldwin | |
| 5,038,509 | A | 8/1991 | Stephan | |
| 5,317,827 | A | 6/1994 | Jaremco | |
| 5,337,505 | A | 8/1994 | Brown et al. | |
| 5,357,705 | A | 10/1994 | Stengel | |
| 5,447,572 | A | 9/1995 | LaClair | |
| 5,557,871 | A | 9/1996 | LaLonde | |
| 5,871,589 | A * | 2/1999 | Hedge | 134/8 |
| 6,269,579 | B1 | 8/2001 | Warner | |
| 6,630,034 | B1 | 10/2003 | Schnell | |
| 6,758,005 | B2 | 7/2004 | Teper | |
| 7,165,673 | B2 * | 1/2007 | Marks | 206/373 |
| 7,356,961 | B2 | 4/2008 | Williams | |
| 7,441,363 | B1 | 10/2008 | Black et al. | |
| 2006/0236584 | A1 * | 10/2006 | Williams | 42/95 |
| 2007/0294930 | A1 | 12/2007 | Mays | |
| 2011/0168207 | A1 * | 7/2011 | Smith | 134/8 |

OTHER PUBLICATIONS

International Search Report and Written Opinion mailed Nov. 2, 2010 (12 pgs.).

* cited by examiner

*Primary Examiner* — Stephen M Johnson
(74) *Attorney, Agent, or Firm* — Harris Beach PLLC

(57) ABSTRACT

A firearm cleaning kit is disclosed that includes a case having first and second compartments joined along a fold line, and a fastener, such as a zipper, joining together the first and second compartments of the case. At least one of the compartments includes a pocket. A flexible cleaning rod having a first end and a second end is removably stored in the pocket. A tool compartment is secured to the fold line. The tool compartment includes a plurality of tool-holding cavities, and a firearm barrel cleaning device is secured within one of the tool-holding cavities. The barrel cleaning device includes a body portion, a swab, and a brush. The swab is fixed to a first end of the body portion, and has an outer diameter greater than an inner diameter of the firearm barrel so as to contact the barrel at all points around its circumference. A brush is also affixed to the body portion proximate to the swab, and has a plurality of filaments arranged and sized to a diameter greater than the inner diameter of the firearm barrel and less than the diameter of the swab. Also disclosed is a method for cleaning residue from an inner diameter of a firearm barrel using the barrel cleaning device.

20 Claims, 6 Drawing Sheets

INTEGRATED DUAL TECHNOLOGY BRUSH

FIELD OF THE INVENTION

This invention relates generally to the field of cleaning kits for firearms.

BACKGROUND OF THE INVENTION

With each use, the breech and bore of a firearm accumulate fouling and debris. Most fouling and debris originates from the firearm itself, such as propellant residue (i.e., carbon deposits), priming compound, and ammunition casings (i.e., copper fragments). But fouling and debris may also originate from the environment if the firearm is used outdoors, such as: dirt, sand, mud, moisture, and plant matter. The presence of such materials can moderately to severely compromise the efficacy of a firearm absent proper periodic cleaning of its barrel. For example, the short term build-up of materials within a firearm barrel can undesirably delay the release time of a bullet or other form of ammunition fired from the firearm. Also, materials that remain within a firearm's barrel for a prolonged period of time can cause corrosion or other significant degradation of the firearm's components, thus potentially necessitating expensive repair or replacement of the firearm. Failure to remove the residue and debris may even pose a safety hazard to the operator. Therefore, proper cleaning is one of the most important elements of firearm ownership.

Although the design of firearm cleaning devices has varied over time, they tend to fall into one of two general design categories: rigid devices and flexible devices. Despite differences in their design, firearm barrel cleaning devices are generally used in similar ways, namely by being inserted within the firearm to loosen or dislodge (e.g., by one or more of brushing, scraping and/or rinsing actions) unwanted materials from within the barrel. The dislodged materials are then removed from the barrel through the use of one or more additional devices.

Because the breeches of firearms typically contain numerous intricate components, a variety of cleaning tools may be needed to thoroughly clean the firearm. A tool cleaning kit may contain brushes, a punch pin, a scraper, and a pick, to name a few. Firearm owners may purchase kits containing the required tools to thoroughly clean a particular model of firearm. Although the kits can be useful and may be advantageous for certain applications, the cleaning process can be time-consuming. Military personnel need to be able to clean their weapons in the field, preferably immediately after shooting so that their firearm is ready for use at all times. Therefore, there is a need to decrease the time and steps required to thoroughly clean a firearm.

SUMMARY OF THE INVENTION

In view of the background, it is therefore an object of the present invention to provide a firearm cleaning kit that expedites the cleaning process.

In one aspect, the cleaning kit includes a case having first and second compartments joined along a fold line, and a fastener, such as a zipper, joining together the first and second compartments of the case. At least one of the compartments includes a pocket. A flexible cleaning rod having a first end and a second end is removably stored in the pocket. A tool compartment is secured to the fold line.

The tool compartment includes a plurality of tool-holding cavities, and a firearm barrel cleaning device is secured within one of the tool-holding cavities. The barrel cleaning device includes a body portion, a swab, and a brush. The swab is fixed to a first end of the body portion, and has an outer diameter greater than an inner diameter of the firearm barrel so as to contact the barrel at all points around its circumference. A brush is also affixed to the body portion proximate to the swab, and has a plurality of filaments arranged and sized to a diameter greater than the inner diameter of the firearm barrel and less than the diameter of the swab.

In another aspect of the invention, the swab is positioned at a tip of the first end of the body portion, and the brush is positioned adjacent the swab.

In another aspect of the invention, the swab is non-abrasive and absorbent.

In another aspect of the invention, the swab is comprised of a plurality of twisted fibers having a nap, and the height of the nap is more than half the inner diameter of the barrel.

In another aspect of the invention, a method for cleaning residue from an inner diameter of a firearm barrel is disclosed. The method includes the steps of providing a firearm having a barrel, wherein the barrel defines a breech end, a muzzle end, and an inner diameter, and the inner diameter of the barrel has residue thereon. The method for cleaning further includes providing a cleaning rod having a first end and a second end, and a firearm barrel cleaning device attached to the second end.

The barrel cleaning device has a body portion, a swab affixed to a first end of the body portion, the swab having an outer diameter greater than the inner diameter of the firearm barrel, and a brush affixed to the body portion, the brush proximate to the swab and having a plurality of filaments, the plurality of filaments arranged and sized to a diameter greater than the inner diameter of the firearm barrel and less than the diameter of the swab. The method of cleaning further includes the steps of securing the firearm barrel cleaning device to the first end of the cleaning rod, inserting the second end of the cleaning rod through the barrel of the firearm, and moving the firearm barrel cleaning device through the length of the barrel in a single direction such that the plurality of filaments scrapes the residue and the swab captures the residue thus scraped.

BRIEF DESCRIPTION OF THE DRAWINGS

The novel features that are characteristic of the preferred embodiment of the invention are set forth with particularity in the claims. The invention itself may be best be understood, with respect to its organization and method of operation, with reference to the following description taken in connection with the accompanying drawings in which:

DETAILED DESCRIPTION OF THE PREFERRED EMBODIMENT

Figure 1:
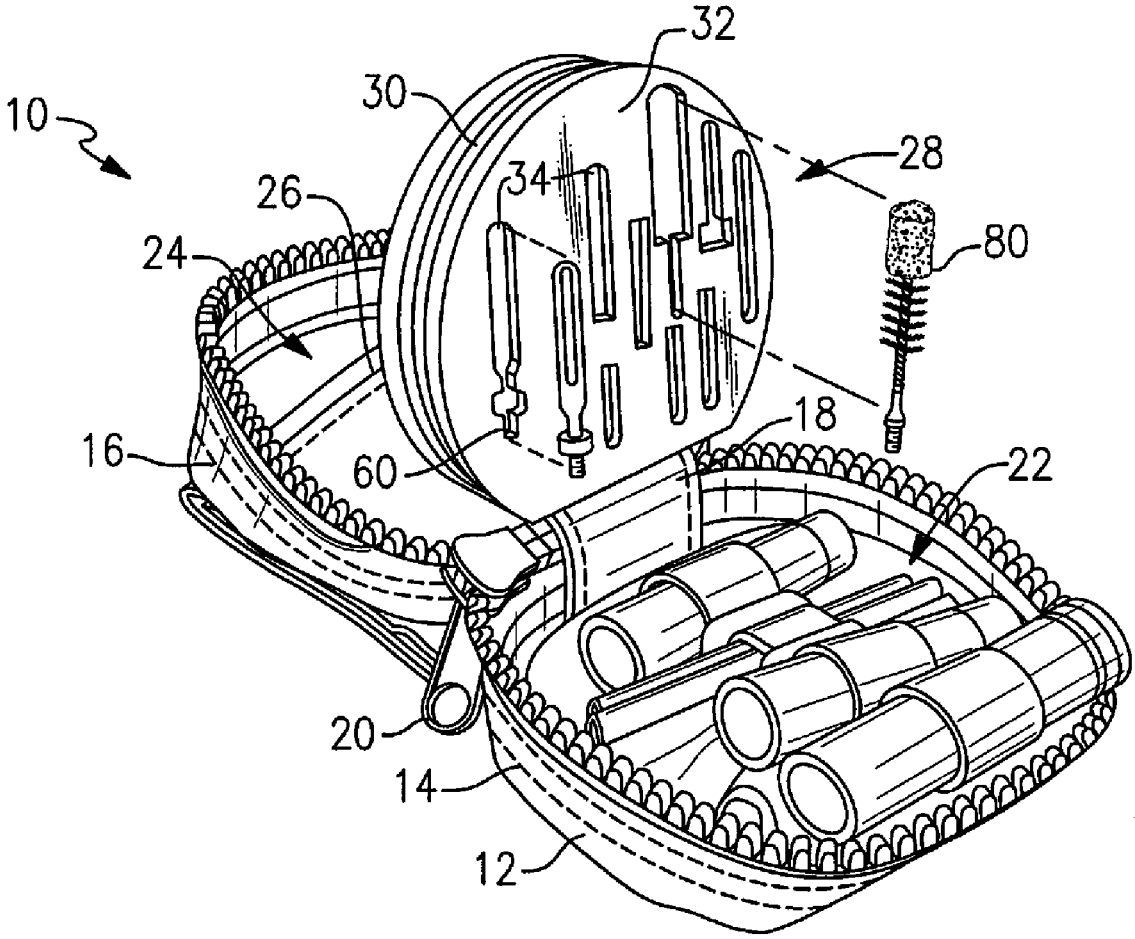
FIG. 1 shows a perspective view of an interior of a firearm cleaning kit according to an embodiment of the invention.

Referring to FIG. 1 of the drawings, an interior view of a firearm cleaning kit 10 is shown. A case 12 includes a first compartment 14 and a second compartment 16 separated by a fold line 18. The fold line 18 joins the first compartment 14 to the second compartment 16, allowing the two to be folded up in a clamshell-type arrangement. In the embodiment shown, the case 12 is generally circular in shape, but any shape that permits the first compartment 14 and the second compartment 16 to be folded together in clamshell fashion is suitable. For example, the case 12 could be square or rectangular in shape, with one side serving as the fold line 18. The case 12 may be made from a soft, durable fabric, or may be a rigid, hard shell construction if increased toughness is required. In the embodiment shown, the case 12 is constructed of nylon fabric to allow some compression.

The kit 10 further includes a fastener 20 to secure the first compartment 14 to the second compartment 16 when the case 12 is in the closed position. The fastener 20 in the disclosed embodiment is a zipper, configured to zip along three sides of the case 12. Other fastener configurations are possible. For example, the fastener 20 may be one or more snaps, flexible strips such as VELCRO® brand fasteners, or ties. The fastener 20 in the preferred embodiment is a silent zipper due to its strength, ease of use, and quiet operation.

The case 12 includes a first interior region 22 defined by the first compartment 14, and a second interior region 24 defined by the second compartment 16. A pocket 26 sewn into the first interior region 22 and/or the second interior region 24 of case 12 holds cleaning materials such as a flexible cleaning rod and bore patches (not shown).

The kit 10 further includes a tool compartment 28 secured to the fold line 18 of the case 12. In the disclosed embodiment, the tool compartment 28 comprises a backing 30 and at least one tool insert 32. The backing 30 may be made of a thin, rigid plastic. The tool insert 32 is secured to the backing 30, and is preferably composed of foamed rubber. The tool insert 32 contains a plurality of tool-holding cavities 34 to hold respective cleaning tools therein. In the example configuration shown, the tool-holding cavities 34 may contain a cleaning tip 60 and a barrel cleaning device 80, features and aspects of which will be explained in detail below. Other examples of cleaning tools held in the tool-holding cavities 34 include slotted tips, picks, adapters, handles, obstruction removers, mats, scrapers, and a bore reflector (all not shown). The tool compartment 28 may also be secured to the first interior region 22 and/or the second interior region 24 of the case 12.

Figures 2, 5:
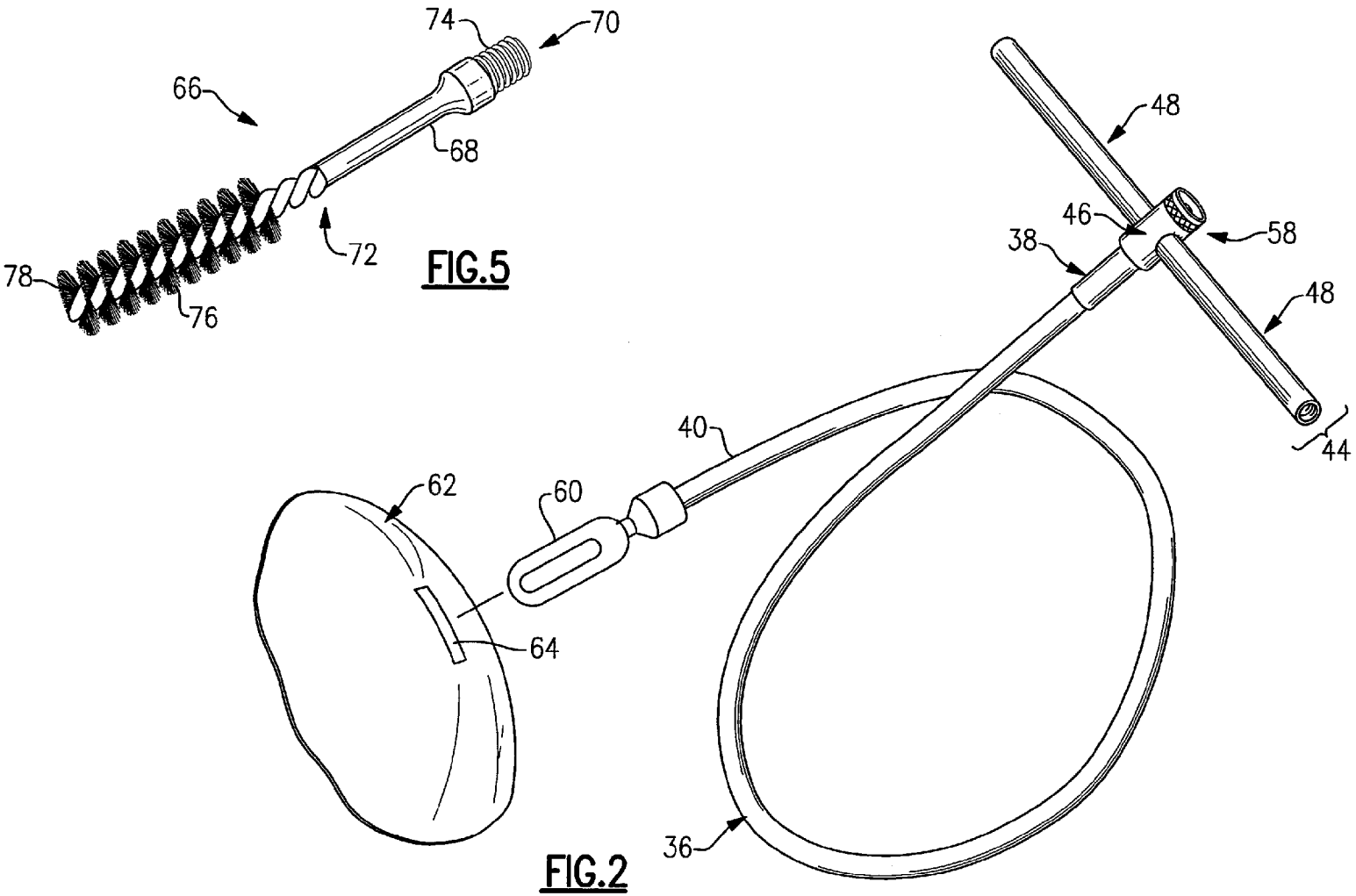
FIG. 2 shows a perspective view of a cleaning attachment for the cleaning kit shown in FIG. 1.
FIG. 5 shows a perspective view of a bore brush for use with the cleaning kit shown in FIG. 1.

Referring to FIG. 2, an example configuration of the firearm cleaning kit 10 is shown. A cleaning rod 36 having a first end 38 and a second end 40 serves as the common base for many of the cleaning attachments. The first end 38 and the second end 40 of the cleaning rod 36 may have a connection element 42 (not shown) such as a threaded member. In this manner, the various cleaning attachments may be quickly and securely attached and removed from the cleaning rod 36. In the example shown, the cleaning rod 36 is flexible. In a preferred example, the cleaning rod 36 is a multi-strand braided wire with plastic coating. The plastic-coated wire may be conveniently coiled and stored in the pocket 26 when not in use.

Figure 3:
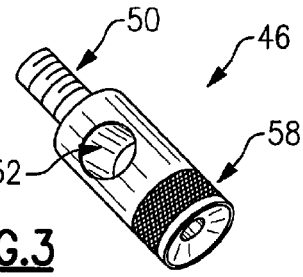
FIG. 3 shows a perspective view of the end adapter of FIG. 2.
Figure 4:
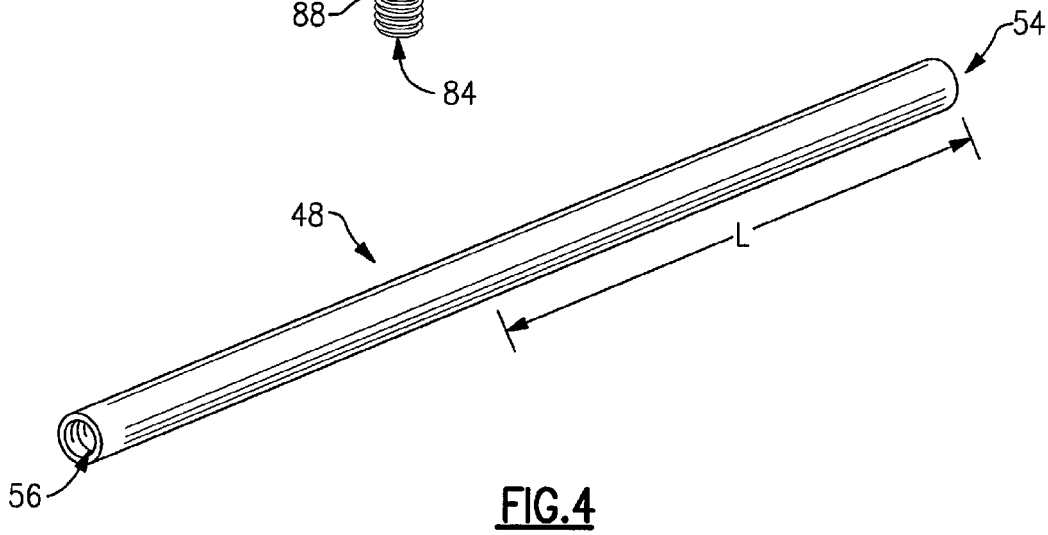
FIG. 4 shows a perspective view of the tee handle bar of FIG. 2.

The first end 38 of the cleaning rod 36 may include a tee handle 44. The tee handle 44 may be of unitary construction or, as shown, may be comprised of an end adapter 46 and a bar 48. As shown in FIGS. 3 and 4, the end adapter 46 includes a threaded portion 50 to removably couple to the first end 38 of the cleaning rod 36. The end adapter 46 defines a thru bore 52 into which the bar 48 is slideably disposed. A first end 54 of the bar 48 may be slightly larger than the diameter of the bore 52. The larger diameter may extend for a length "L", as shown in FIG. 4, and taper to the nominal diameter of the bar 48. In this manner, a second end 56 of the bar 48 may slide through the bore 52 in the end adapter 46, but will only slide up to the larger diameter, thus positioning the bar 48 at its mid-section. When the tee handle 44 is assembled to the first end 38 of the cleaning rod 36, a handle is formed. A knurl 58 may be formed on the tee handle 44 to aid in threading the tee handle to the cleaning rod 36.

Referring now back to FIG. 2, one example attachment to cleaning rod 36 is a cleaning tip 60, which may also threadably couple to the second end 40 of the cleaning rod. The cleaning tip 60 secures a cleaning patch 62. The cleaning patch 62 includes at least one slit 64 through which the cleaning tip 60 is placed in order to secure the patch for cleaning.

Referring to FIG. 5, another attachment for the cleaning rod 36 is a bore brush 66. The bore brush 66 includes a core 68 defining a first end 70 and a second end 72. In the example shown, the core 68 is comprised of brass and includes a threaded member 74 on the first end 70 to threadably couple to the second end 40 of the cleaning rod 36 (FIG. 2). The core 68 further includes a hollowed-out or tubular segment on the second end 72 into which a brush portion 76 is inserted. Once inserted, the second end 72 may be cold-welded or otherwise formed to secure the brush portion 76 in place. The brush portion 76 includes wire-wound strands of brass securing a plurality of bristles 78. The bristles 78 are preferably brass to aid in scraping residue from the barrel of a firearm.

To clean a firearm barrel with the cleaning apparatus described above, the cleaning patch 62 and the bore brush 66 are alternately moved through the barrel of the firearm. In one example, the cleaning patch 62 is first attached to the second end 40 of the cleaning rod 36. The first end 38 of the cleaning rod 36 is pushed through the barrel from breech to muzzle, then pulled through to drag the cleaning patch 62 through the bore to pick up dirt and abrasive particles. A solvent may be applied to the patch 62 to lubricate the bore and prevent sand or dirt from scratching the muzzle end of the barrel.

Next, the bore brush 66 is threadably coupled to the cleaning rod 36 and pulled through the bore in the same manner. The bore brush 66 serves to scrape the chamber of the firearm and loosen any residue adhered to the barrel. Any residue loosened by the bore brush 66 must be removed by the cleaning patch 62 prior to running the bore brush through the barrel again. If this important step is omitted, residue will be entrained in the bristles 78 of the bore brush 66 and be deposited in the chamber or bore the next time the brush is run through. The stiff bristles 78 will drag the residue through the bore, marring and scratching it.

Figure 6:
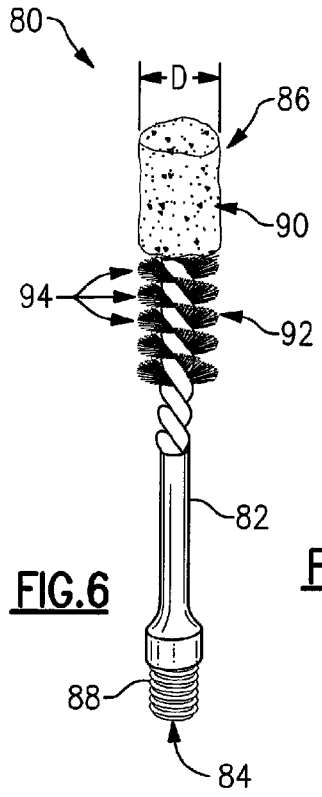
FIG. 6 shows a barrel cleaning device according to an embodiment of the invention.

As may be evident from the foregoing description, repeatedly exchanging the cleaning patch 62 and the bore brush 66 may become tedious and consumes time. In some situations, such as military environments, the firearm owner may chose to skip at least some of the exchanging steps if they are in a time-critical environment. This could lead to degradation or even malfunctioning of the firearm. The inventor has devised a barrel cleaning device 80 that alleviates the foregoing problems without sacrificing the thoroughness of the cleaning Referring now to FIG. 6 of the drawings, the firearm barrel cleaning device 80 is shown in detail. The barrel cleaning device 80 includes a fixed body portion 82 defining a first end 84 and a second end 86. The first end 84 of the body portion 82 may be adapted with a connector portion 88 to removably couple the first end 84 to the first end 38 of the cleaning rod 36. In the disclosed example, the body portion 82 and the connector portion 88 are made of brass. The connector portion 88 is a male thread adapted to mate with a female thread on the first end 38 of the cleaning rod 36.

The barrel cleaning device 80 further includes a swab 90 affixed to the body portion 82. The swab 90 is made of a soft, non-abrasive material that is also absorbent. The swab 90 has an outer diameter "D" that is greater than the inner diameter of the firearm barrel for which the barrel cleaning device 80 is intended. In this manner, the swab 90 will absorb a solvent, and fully contact the entire inner diameter of the barrel while being moved therethrough.

The barrel cleaning device 80 further includes a brush 92 affixed to the body portion 82, proximate to the swab 90. The brush 92 has a plurality of filaments 94 arranged and sized to a diameter greater than the inner diameter of the firearm barrel and less than the diameter "D" of the swab 90. In the disclosed embodiment, the filaments 94 are brass. The brass filaments 94 are stiff to provide superior scraping action, but soft enough to prevent scratching the inner bore of the firearm. The body portion 82 of the barrel cleaning device 80 may include a wire-wound stem portion to reliably secure the filaments 94. The wire-wound stem may be secured to the body portion 82 by cold welding, for example.

As used herein, "proximate" means the brush 92 and swab 90 are spaced close enough to reliably work in tandem while disposed on the same tool. The brush 92 and swab 90 work in tandem because the residue scraped from the inner bore of the firearm does not re-deposit itself; it is quickly absorbed onto the swab. In a preferred example, the brush 92 is positioned adjacent the swab 90. In this manner, as the stiff filaments 94 scrape off the residue from the inner bore of the firearm, the filaments 94 will tend to "flick" the particles rearward (opposite to the motion of cleaning rod 36) directly onto the swab 90. The amount of residue re-deposited on the inner bore of the firearm during the cleaning process is thus minimized The diameter of the brush 92 is less than the diameter of the swab 90 to assure ease of movement through the bore on the part of the brush while simultaneously assuring the swab is adequately compressed to contact the entire bore and capture all the residue created by the brush.

The body portion 82, connector portion 88, and wire-wound stem are preferably made of brass for durability and corrosion protection. In one example, the swab 90 is made of a plurality of twisted fibers that are also secured in the wire-wound stem portion. The twisted fibers define a nap, the nap having a height that is greater than half the inner diameter of the firearm barrel. This nap height similarly assures the swab 90 is adequately compressed to contact the entire bore and capture the residue created by the brush. The twisted fibers may be looped or frayed, but the frayed configuration provides superior absorbency.

Figure 7:
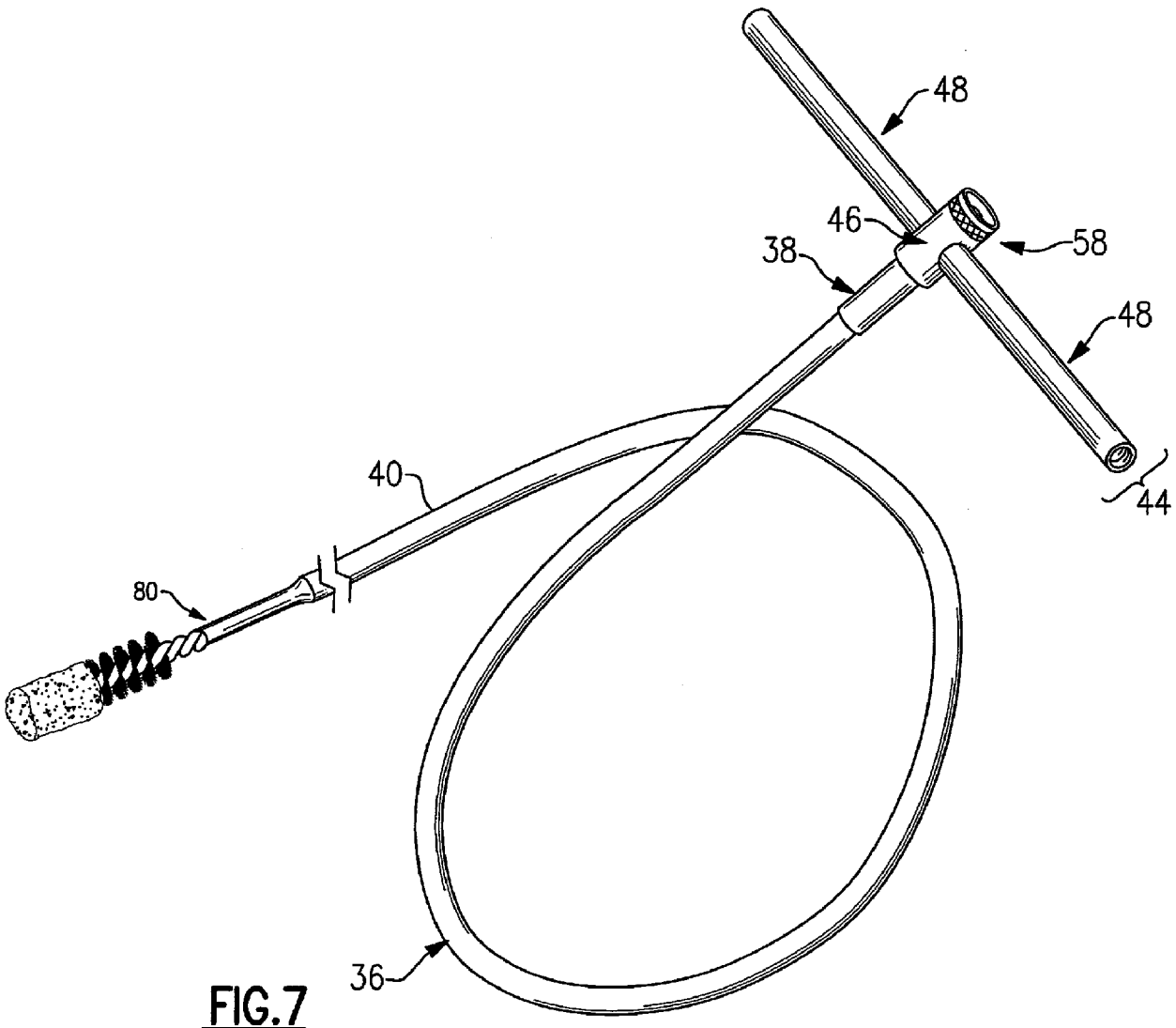
FIG. 7 shows a perspective view of a cleaning attachment using the barrel cleaning device of FIG. 6.

Referring to FIG. 7 of the drawings, another example attachment to the cleaning rod 36 is shown. In this example, the barrel cleaning device 80 is secured to the second end 40 of the cleaning rod 36 and the firearm barrel may be cleaned using the barrel cleaning device 80 as described. In the following example, a procedure is disclosed to clean the bore of a shotgun. However, the method steps are applicable to virtually any type of firearm without departing from the scope of the invention.

The action of the shotgun is first opened as if inserting a shell. The first end 38 of the flexible cleaning rod 36 is pushed down the barrel from breech to muzzle. The first end 38 may have an obstruction remover (not shown) to dislodge any mud or snow from the barrel. An initial cleaning and lubrication step is performed as described above using the cleaning tip 60 and the cleaning patch 62. Solvent is applied to the cleaning patch 62 to lubricate the bore and prevent sand or dirt from scratching the muzzle end of the barrel. The solvent may be Otis O85® Ultra Bore® solvent from Otis Technologies, Lyons Falls, N.Y. The cleaning rod 36 with patch 62 is pulled out through the muzzle in the direction of the shot. If needed, e.g., the rod 36 and patch 62 pulls hard, the tee handle 44 may be secured to the first end 38 of the rod.

After the initial cleaning and lubrication step, the cleaning tip 60 is removed and the brush 92 is secured to the second end 40 of the cleaning rod 36. The first end 38 of the flexible cleaning rod 36 is pushed down the barrel from breech to muzzle as before, and a few drops of solvent are applied to the swab 90. The first end 38 of the rod 36 is grasped and pulled through the muzzle. The tee handle 44 may be utilized, if needed. The swab 90 gives 360-degree coverage so the entire surface of the chamber, forcing cone, barrel and choke are cleaned with one pull.

After the barrel cleaning device 80 has been pulled through the bore, it is not necessary to re-attach the cleaning tip 60 and cleaning patch 62 to clean the residue out of the bore. The swab 90 accomplishes this function, saving time and process steps. After wiping down the swab 90 to remove the residue, the barrel cleaning device 80 may be re-inserted from the breech and the cleaning process may be repeated.

Figure 8:
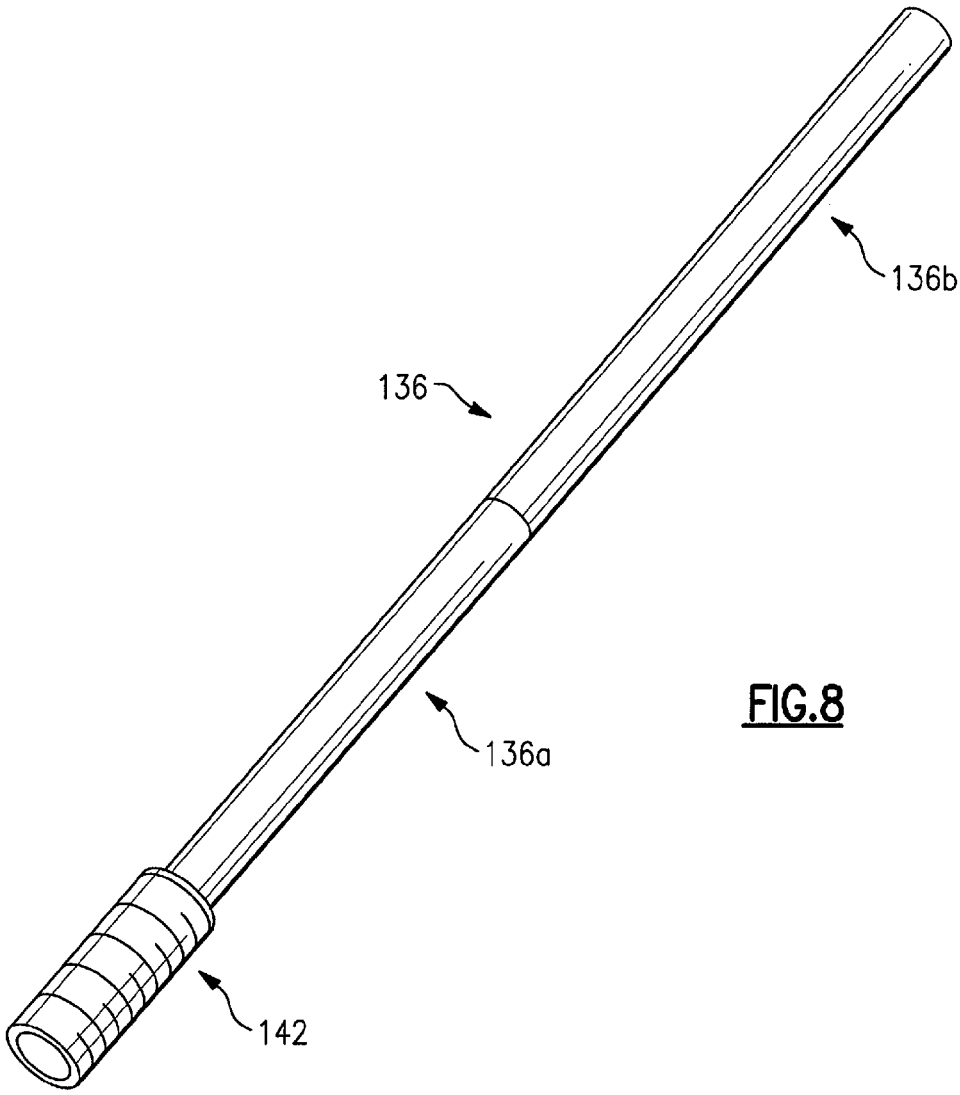
FIG. 8 shows a perspective view of an alternate cleaning rod for use with the barrel cleaning device of FIG. 7.
Figure 9:
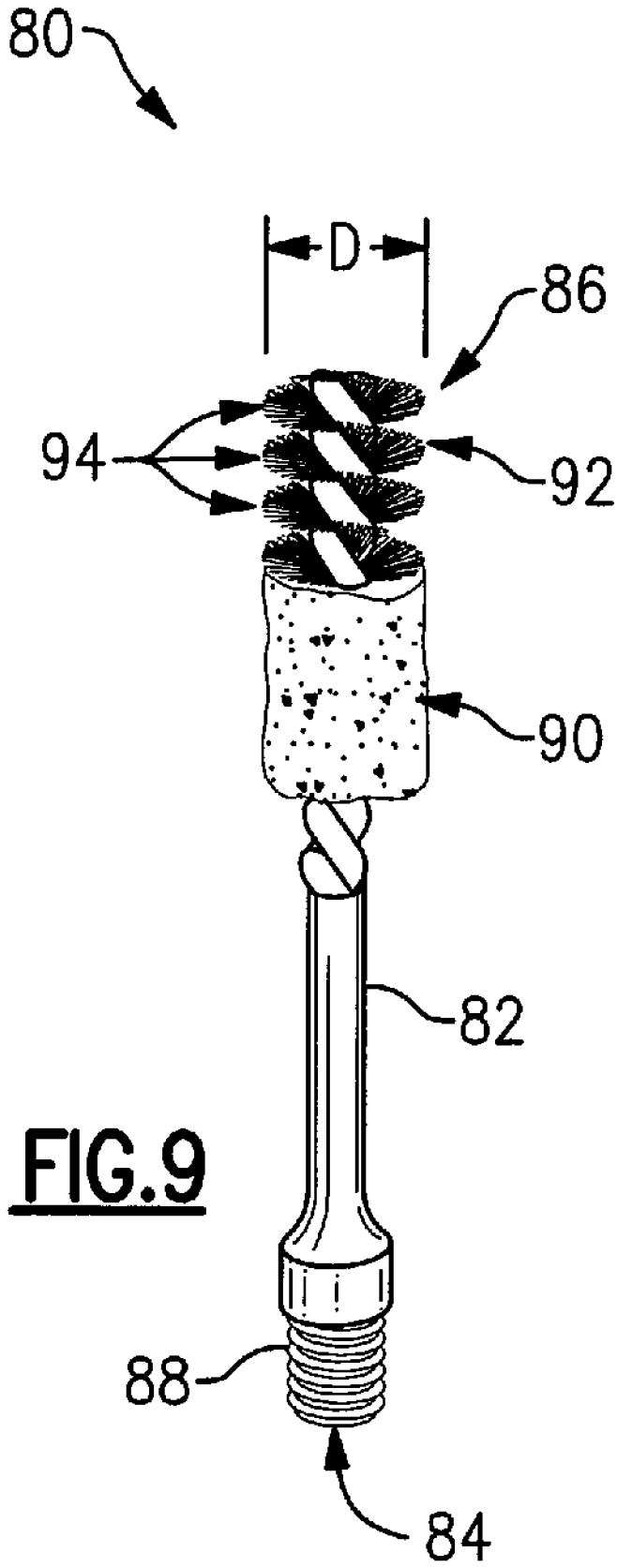
FIG. 9 shows an alternate embodiment of the barrel cleaning device of FIG. 6.

Referring now to FIG. 8 of the drawings, wherein like numerals indicate like elements, an alternate embodiment of the cleaning rod is shown. In this embodiment, the cleaning rod 136 is rigid and includes a plurality of cleaning rod segments 136*a*, 136*b* that may be coupled together, for example by threading together. The rigid cleaning rod 136 may be assembled and inserted down the bore at the muzzle end, and the barrel cleaning device 80 may be attached to the cleaning rod from the breech end. The cleaning procedure would then proceed as described above.

The barrel cleaning device 80 may have utility cleaning tubular devices other than gun barrels, particularly when the tube cleaning requires application of a cleaning solvent and a wire-brushing action. In one example, the barrel cleaning device 80 may be used to remove soft and light scale deposits in ferrous or non-ferrous tubes, such as heat exchanger tubes, boiler tubes, or condenser tubes. The cleaning device 80 offers an advantage over present cleaning methods which require multiple separate cleaning steps. For example, one current method to remove scale deposits from the inside of a heat exchanger tube includes a first step for applying de-scaling chemicals, a second step to collect and remove excess de-scaling chemicals, a third step for mechanical scrubbing of the scale deposits, and a fourth step to remove the scale deposits from the inside of the tube. Utilizing the cleaning device 80 of the present invention, the scale deposits may be removed in a single step. In one example, a de-scaling chemical is applied to the swab 90 and the cleaning device 80 is inserted into the tube and agitated in a forward and backward motion. The chemicals on the swab 90 help dissolve the scale, and the filaments 94 on the brush 92 scrape the scale from the inside of the tube walls. The filaments 94 may be nylon, brass, or stainless steel. The removed scale is collected on the swab 90 for easy removal from the tube.

Other applications for the cleaning device 80 are contemplated. In another example, the cleaning device 80 is used to deburr and remove debris from the inside of a tube that has been cut or machined off. The cutting process often leaves sharp edges and filings on the inside of the tube. In this example, the filaments 94 may be brass or stainless steel. A solvent is applied to the swab 90 and the cleaning device 80 is inserted into the tube. By utilizing a twisting, forward and backward motion, the filaments 94 of the cleaning device 80 will deburr the sharp internal edges of the tube and the swab 90 will simultaneously remove debris such as metal filings.

In other applications, the cleaning device 80 may be utilized to apply protective, inhibitive, or preventative coatings to the inside of a tube or duct during a cleaning process. In one example, a mold-inhibiting chemical is applied to the swab 90 during routine cleaning of air conditioner heat exchanger tubes or ducts. The filaments 94 may have soft bristles for removing dust or soot within a duct.

The cleaning device 80 of the present invention may be used in laboratory environments to clean and sterilize glassware. In one example, the filaments 94 of the cleaning device 80 may comprise stiff nylon. A cleaning/sterilization agent may be applied to the swab 90. As the glassware is cleaned, the filaments 94 remove debris, while the swab 90 collects the debris. The cleaning device 80 may similarly be used to clean and sterilize tubes or conduits in food processing industries.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

I claim:

1. A firearm cleaning kit for use in cleaning an inner diameter of a barrel of a firearm, comprising:

a case having first and second compartments joined along a fold line, at least one of the compartments having a pocket;

a fastener for joining together the first and second compartments of the case;

a cleaning rod removably stored in the pocket, the cleaning rod having a first end and a second end, at least the second end having a connection element;

a tool compartment secured to the fold line, the tool compartment comprising a backing secured to the fold line and at least one tool insert secured to the backing, the at least one tool insert having a plurality of tool-holding cavities; and a barrel cleaning device secured within at least one of the tool-holding cavities, the barrel cleaning device comprising a body portion, a swab affixed to a first end of the body portion, the swab having an outer diameter greater than the inner diameter of the firearm barrel, the swab comprised of a plurality of twisted fibers having a nap, a height of the nap being more than half the inner diameter of the barrel, and a brush affixed to the body portion, the brush adjacent to the swab and having a plurality of filaments extending radially outward from the body portion, the plurality of filaments arranged and sized to a diameter greater than the inner diameter of the firearm barrel and less than the diameter of the swab.

2. The firearm cleaning kit according to claim 1 wherein the filaments are brass.

3. The firearm barrel cleaning device according to claim 1, wherein the swab is positioned at a tip of the first end of the body portion.

4. The firearm cleaning kit according to claim 1 wherein the cleaning rod is a flexible multi-strand braided and coated wire.

5. The firearm cleaning kit according to claim 1 wherein a second end of the body portion of the barrel cleaning device is configured to attach to the second end of the cleaning rod.

6. The firearm cleaning kit according to claim 1 further comprising a cleaning patch removably stored in the pocket.

7. The firearm cleaning kit according to claim 1 further comprising a cleaning tip secured within at least one of the tool-holding cavities, the cleaning tip configured at a first end to secure the cleaning patch and further configured at a second end to attach to the second end of the cleaning rod.

8. The firearm cleaning kit according to claim 1 further comprising a wire brush secured within at least one of the tool-holding cavities, the wire brush having an outer diameter greater than the inner diameter of the firearm barrel.

9. The firearm cleaning kit according to claim 1 wherein the tool insert is comprised of foam.

10. The firearm cleaning kit according to claim 1 further comprising a tee handle secured within at least one of the tool-holding cavities.

11. The firearm cleaning kit according to claim 10 wherein the tee handle comprises an end adapter and a bar, the end adapter having a thru bore at a first end and configured to thread onto the first end of the cleaning rod, the thru bore configured to accept the bar.

12. A firearm barrel cleaning device intended for use in cleaning an inner diameter of a barrel of a firearm, the barrel cleaning device comprising:

a fixed body portion defining a first end and a second end, the second end having a connector portion;

a swab affixed to the first end of the body portion, the swab having an outer diameter greater than the inner diameter of the firearm barrel, wherein the swab is comprised of a plurality of twisted fibers having a nap, a height of the nap being greater than half the inner diameter of the barrel; and a brush affixed to the body portion, the brush adjacent to the swab and having a plurality of filaments extending radially outward from the body portion, the plurality of filaments arranged and sized to a diameter greater than the inner diameter of the firearm barrel and less than the diameter of the swab.

13. The firearm barrel cleaning device according to claim 12, wherein the body portion comprises a wire-wound stem securing the filaments and the swab.

14. The firearm barrel cleaning device according to claim 13, wherein the filaments are metallic.

15. The firearm barrel cleaning device according to claim 14, wherein the filaments are brass.

16. The firearm barrel cleaning device according to claim 12, wherein the swab is positioned at a tip of the first end of the body portion.

17. The firearm barrel cleaning device according to claim 12, wherein the swab is non-abrasive and absorbent.

18. The firearm barrel cleaning device according to claim 12, wherein the plurality of twisted fibers are frayed at their respective ends.

19. The firearm barrel cleaning device according to claim 12, wherein the connector of the body portion is a threaded connector.

20. The firearm barrel cleaning device according to claim 19, wherein the threaded connector is a male thread.

* * * * *